US009283599B2

(12) United States Patent
Cernuschi et al.

(10) Patent No.: US 9,283,599 B2
(45) Date of Patent: Mar. 15, 2016

(54) PROCESS FOR ROLLING TUBES IN A CONTINUOUS MULTI-STAND ROLLING MILL

(75) Inventors: Ettore Cernuschi, Castelletto Sopra Ticino (IT); Claudio Maria Scalmana, Milan (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 952 days.

(21) Appl. No.: 13/416,016

(22) Filed: Mar. 9, 2012

(65) Prior Publication Data

US 2013/0061646 A1 Mar. 14, 2013

(30) Foreign Application Priority Data

Mar. 10, 2011 (IT) ..... MI2011A0372

(51) Int. Cl.
*B21B 17/04* (2006.01)
*B21B 25/02* (2006.01)

(52) U.S. Cl.
CPC ..... *B21B 17/04* (2013.01); *B21B 25/02* (2013.01)

(58) Field of Classification Search
CPC ..... B21B 25/00; B21B 25/02; B21B 25/06; B21B 17/00; B21B 17/04; B21B 17/06; B21B 17/08; B21B 17/10; B21B 17/12; B21B 17/14
USPC ..... 72/201, 208, 200, 202, 209, 95, 96, 97, 72/98, 236, 251, 39, 40, 41, 250
See application file for complete search history.

(56) References Cited

U.S. PATENT DOCUMENTS

| | | | | |
|---|---|---|---|---|
| 3,577,754 | A * | 5/1971 | Calmes | 72/45 |
| 3,946,586 | A * | 3/1976 | Calmes | 72/201 |
| 4,037,449 | A * | 7/1977 | Schuetz | B21B 17/12 72/209 |
| 4,091,650 | A * | 5/1978 | Peytavin | 72/209 |
| 4,592,222 | A * | 6/1986 | Muller et al. | 72/97 |
| 9,205,473 | B2 * | 12/2015 | Cernuschi | B21B 25/02 |
| 2010/0212387 | A1 * | 8/2010 | Hoeffgen et al. | 72/209 |

FOREIGN PATENT DOCUMENTS

| | | |
|---|---|---|
| DE | 102008039454 | 3/2010 |
| EP | 1854561 | 11/2007 |
| WO | WO2011000819 | 1/2011 |

* cited by examiner

*Primary Examiner* — Alexander P Taousakis
*Assistant Examiner* — Pradeep C Battula
(74) *Attorney, Agent, or Firm* — Stetina Brunda Garred & Brucker

(57) ABSTRACT

A tube rolling plant (R) with multi-stand rolling mill having two or more rollers, for implementing a mandrel rolling process with controlled speed has a mandrel (31) which is inserted into the hollow body (39) from the frontal opening thereof by passing it first through the rolling mill (5). An opposite movement (L3) with respect to the rolling direction is imparted to the mandrel (31) by way of the hooking device (61) when rolling the hollow body (39) and the rear end of the rolled tube (42) is extracted at the end of the rolling operation.

10 Claims, 5 Drawing Sheets

PROCESS FOR ROLLING TUBES IN A CONTINUOUS MULTI-STAND ROLLING MILL

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Field of the Invention

The present invention relates to a process for rolling tubes in a continuous multi-stand rolling mill operating with a mandrel.

2. State of the Art

Longitudinal multi-stand rolling mills operating with a mandrel of the known art may be conventionally grouped into various types, according to their architecture and paying special attention to the control of the rolling speed and to the speed and position of the mandrel within the tube.

Continuous rolling mills with floating mandrel, i.e. free mandrel, are those in which the mandrel may freely move within the tube when passing in the multi-stand rolling mill for the rolling operation, according to the friction forces which are generated between the mandrel and the inner wall of the tube. Hence, the mandrel accelerates as the rolling stands sequentially take hold. The extraction of the mandrel from the tube occurs at the end of the rolling operation, outside the rolling line, or in any event when the tail of the tube has left the last rolling stand, and therefore when the free mandrel has taken the same feeding speed as the tube. Very short cycle times and hence high productivity, e.g. 4-5 pieces per minute, are obtained with these types of rolling mills.

On the other hand, this type of rolling mill is subject to various drawbacks. The mandrel acceleration causes states of compression in the tube which are detrimental to the dimensional quality and the defectiveness of the tubes, because the groove delimited by the rolling rollers is plugged (which status is conventionally referred to as "overfilling") in the first stands and is choked (which status is referred to as "underfilling") in the finishing stands at the end of the rolling mill. Therefore, problems of rolling stability and of products with too large tolerances are encountered. Moreover, the tube cooling over the length of the tube is uneven because the head part of the tube no longer reached by the mandrel remains hot longer right after the first rolling step, while the rear part where the mandrel is still inserted as the rolling operation continues is partly cooled by the mandrel with which it is in contact. In these rolling mills, there is normally the need to provide a heating furnace downstream in order to standardize the temperature of the tube before the final rolling operation which serves to calibrate or further decrease the tube diameter.

A second type of rolling mill is that called "semi-retained-mandrel rolling mill", in which the mandrel is retained and fed more slowly than the tube, at the technologically favourable speed during the rolling operation. At the end of the rolling operation, once the tube tail has left the last rolling stand, the mandrel is released from the retaining device while remaining within the tube and following it while it is moved away from the rolling line. The extraction of the mandrel from the tube occurs outside the rolling line, or in any event when the tube tail has left the last rolling stand, and therefore when the free mandrel has taken the same feeding speed as the tube. Very short cycle times and hence high productivity, e.g. 3-4 tubes per minute, are obtained with this type of rolling mills.

On the other hand, equivalent problems are encountered with rolling mills of the above type with regards to the non-evenness of the temperature along the tube. A third type of rolling mill is that called "retained-mandrel rolling mill", which is characterized by a device for retaining the rack-and-pinion mandrel. At the end of a tube rolling operation, when the tube tail leaves the last rolling mill stand, the tube has already been previously grasped at the head portion downstream of the rolling mill by an extracting device, which grasps the outer surface of the tube. The extracting device, which is generally in the shape of a particular sequence of roller rolling stands, drags the tube forwards in the same direction as the rolling, while the retaining system blocks the mandrel so that it is extracted from within the tube, and it pulls it backwards towards the inlet side of the rolling mill from where it is then unloaded and put back into the classical mandrel transport cycle. The extracting device or rolling mill also serves the function of decreasing the outer diameter of the tube by further rolling it without the inner mandrel when this has been extracted. The cycle times are longer in this type of rolling mill and therefore it has less productivity than the previously described types: 2 tubes per minute may generally be rolled.

In traditional rolling operations in retained-mandrel plants, during the rolling step the mandrel is fed at controlled speed, also called retaining speed, directed in the same motion direction as the tube, from the inlet to the outlet of the multi-stand rolling mill during the complete rolling cycle.

Normally, at the beginning of each rolling cycle in rolling processes implemented with this type of rolling mill, the mandrel is first inserted into the hollow body at the tail, in the direction of the head of the same hollow body with motion in the same direction as the direction of the tube rolling.

This first operation may occur in-line with the rolling axis, in this case it is called in-line insertion, or out-of-line, in this case it is called pre-insertion, as pre-inserting the mandrel into the hollow body is used to decrease the travel of the mandrel retaining devices, thus decreasing the cycle time of the rolling mill and increasing its productivity. Therefore, a limit in this technology is its low productivity, in particular for the rolling mills used for rolling small and medium tubes, e.g. those with nominal diameter less than or equal to 7" (177.8 mm).

Another type of rolling mill is that called "retained-mandrel rolling mill" with extractor and with tube release at the end of the rolling operation, with the mandrel passing through the extractor. The rolling process carried out in this type of rolling mill provides that at the end of the tube rolling operation, the mandrel is immobilized by the specific retaining device while the tube is extracted from the mandrel by means of the extracting device by pulling it along the rolling line. Once the hollow body has completely passed through the extracting device, the mandrel is then released from the retaining device, conveyed forwards by pressing rollers along the rolling line, and is caused to pass through the extracting device immediately after the tube and lastly unloaded downstream of the extractor to follow the circuit arranged for reusing the mandrels. Relatively short cycle times (2.5 tubes per minute) are obtained in this type of rolling mills.

A drawback of this type of rolling mill is that the process includes conveying the mandrel, which is still very hot, by means of pressing rollers with the risk of damaging the mandrel surface. In this type of process, the mandrel retaining device in the rolling step, normally of rack type, is to provide a releasing device which operates in cycle, adapted to release the mandrel after the extraction of the tube.

To carry out the rolling process in a retained-mandrel rolling mill, passing the mandrel through the extracting device or rolling mill requires that the latter is provided with a stand which can rapidly open and close to first allow the rolled tube and then the mandrel to pass at each rolling cycle, given the high speeds at which tubes and mandrels move along the rolling line. If accuracy is not ensured in this operation of the extracting device, the risk may occur of misaligning the corners of two adjacent rollers and then longitudinally marking the rolled tube.

Processes with retained-mandrel rolling mills are advantageous with regards to the quality of the tube obtained and the thermal conditions with which the tube leaves the rolling mill, indeed only in this type of rolling mill the calibration to the final diameter of the tube may be provided even without intermediate heating.

To also ensure an efficient rolling process, both of retained and semi-retained type, it is worth arranging a retaining device which ensures the stability of the mandrel speed, is sturdy, and provides the possibility of hooking and releasing the mandrel without a chain and star system. Indeed, in the case of a rolling mill with semi-retained or retained mandrel, the device having a chain wound on stars and equipped with hooking gears is not advantageous due to the premature wear which occurs, to the noisiness and lengthening of the chain itself as operating time passes. To obviate such drawbacks of the chain system, in some known plants of retained-mandrel and controlled-speed type, in-cycle hooking and releasing systems were provided to develop rolling methods with a low cycle time. However, these systems do not operate centered with the pull axis of the mandrel, and therefore problems arise associated with bending loads acting on the hooking/releasing systems.

A rolling mill and retained-mandrel rolling process associated thereto is disclosed in document WO2011/000819, where after the extraction of the tube while the mandrel is still retained and the tube is transported and rolled through the extracting device without the mandrel therein, the mandrel is laterally removed from the rolling line with respect to the rolling line. However, in the known retained-mandrel plants described above, it is difficult to produce short tubes as the latter are shorter than the distance between the axis of the last stand of the multi-stand rolling mill and the first stand of the extractor.

The market requires rolling plants which allow increased flexibility of final product, i.e. are capable of rolling tubes of various lengths, with replacement operations over a minimum amount of components of the plant, which allow the tube rolling cycle time to be decreased and the overall productivity of the plant to be enhanced, which increase the quality of the finished tube or at least do not penalize it, which have a more rational structure than the plant itself, thus decreasing the production and handling cost thereof.

Generally, longitudinal rolling mills of the above-described types are also defined according to parameters such as:

- Number of rollers per rolling stand (generally 2 or 3),
- Possibility, or not, of loading the hollow body on the inlet side of the rolling mill with the mandrel already pre-inserted or with the mandrel inserted in-line,
- Presence, or not, of calibrating stands of the tube upstream of the first rolling stand,
- Presence, or not, of rounding stands arranged downstream of the last rolling stand, which roll the thickness of the tube between rollers and mandrel still arranged within the tube. Normally, the rounding stands are used in those rolling processes in which the extraction of the mandrel from the tube is performed out-of-line.

BRIEF SUMMARY

The main object of the present invention is to carry out a process for rolling tubes in a continuous multi-stand rolling mill operating with a mandrel, which is more productive than known processes and may be implemented on rolling mills which are more affordable to build and to manage without decreasing the productivity of the rolling process.

Another object of the invention is to provide a rolling plant for optimally implementing the above rolling process and which is affordable to manufacture and to implement.

These objects are achieved according to a first aspect of the invention, by means of a process for rolling a tube from a hollow body having an inner cavity, using at least one mandrel, wherein a rolling plant is provided, comprising a rolling mill with a plurality of rolling stands, defining a rolling axis, a rolling direction, an inlet side defined upstream of the rolling mill, an outlet side defined downstream of the rolling mill, wherein a first loading device, a first unloading device and a first mandrel conveyor are provided on the inlet side, and a second unloading device, a second loading device and a second mandrel conveyor are provided on the outlet side, said process comprising, in a rolling cycle, the following stages:

- loading the hollow body along rolling axis from the inlet side by means of said first loading device,
- loading the at least one mandrel along rolling axis from the outlet side by means of said second loading device and connecting a first end area of the at least one mandrel to said second conveyor,
- axially translating the at least one mandrel along rolling axis through the rolling mill and through the inner cavity of the hollow body,
- integrally fixing a second end area of the at least one mandrel to said first conveyor and releasing the first end area of the at least one mandrel from said second conveyor,
- rolling the hollow body by passing the same through rolling stands of the rolling mill in the rolling direction, so as to produce a rolled tube while simultaneously feeding the mandrel by the first conveyor in the direction opposite to the rolling direction,
- completely extracting the mandrel from within the rolled tube and from the rolling mill.

The aforesaid objects are also achieved, according to a second aspect of the invention, by means of a rolling plant for tubes of defined length, adapted to implement a rolling process as described above, comprising a rolling mill incorporating a plurality of rolling stands adapted to roll a hollow body at each rolling cycle, defining a rolling axis, a rolling direction and a rolling cycle for each rolled tube, at least one mandrel adapted to cooperate with the rolling mill in said rolling at each rolling cycle, a first loading device, adapted to load the hollow body at each rolling cycle along rolling axis, a first unloading device, adapted to unload the at least one mandrel from the rolling axis, a first mandrel conveyor, adapted to grasp and to release a rear end of said at least one mandrel, arranged upstream of the rolling mill, and a second unloading device, adapted to unload the rolled tubes from the rolling axis, a second loading device adapted to load the at least one mandrel along rolling axis, a second mandrel conveyor, adapted to grasp and to release a front end of said at least one mandrel, arranged downstream of the rolling mill, control means of the rolling plant which allow the first conveyor to grasp and release said rear end of the at least one mandrel at each rolling cycle co-ordinately to releasing and grasping, respectively, said front end of the at least one mandrel by the second conveyor.

Therefore, in the rolling process of the invention, the mandrel used in the rolling cycle is inserted into the hollow body in-line, but by proceeding in the opposite direction through the multi-stand rolling mill, inversely as compared to the normal operation in the retained-mandrel rolling mills, i.e. in the direction opposite to the rolling direction, by entering the last rolling mill stand with the tail end first.

Due to the innovative features of the rolling process of the invention, the extracting device or rolling mill may be eliminated from the plant while keeping however those advantages obtained when a retained-mandrel rolling process of known type is used. A further advantage directly resulting from the process of the invention is to have the possibility of rolling tubes of various lengths, in particular even shorter tubes with respect to those commonly produced today, i.e. with lengths greater than about 8-10 mm at the outlet of the multi-stand rolling mill.

Not using the extracting rolling mill at the end of the rolling line allows tubes with a smaller wall thickness to be obtained. Indeed, when there is an extracting rolling mill in a retained-mandrel rolling mill, as is normally the case in the state of the art, there is a reduced possibility of rolling thin tubes, i.e. with high diameter/thickness ratios. This is because an extracting rolling mill normally serves a further rolling function which generates a 3%-5% decrease of the outer diameter of the tube and, when the mandrel is not therein, this operation involves thickening the tube wall by 1.5%-2.5%. In essence, there would be a 4.5%-7.5% decrease in the ratio of the outer diameter of the tube to it thickness. This is avoided due to the process of the invention.

However, as the process of the invention is derived from a retained-mandrel rolling process, the same advantages of such a type of rolling mill are kept, and the possibility of decreasing the final diameter of the tubes is improved while avoiding intermediate heating between the mandrel rolling stages and the stage of decreasing the final diameter which, in retained-mandrel rolling mills of the known art, is normally carried out on a rolling mill of calibrating or stretch-reducing type.

In short, the mandrel which is used for a particular rolling cycle is loaded downstream of the rolling mill, reversely inserted into the multi-stand rolling mill by means of a mandrel conveyor, as the latter is arranged downstream of the rolling mill. The hollow body which is to be rolled with that particular mandrel is loaded by translating it transversally to the rolling direction and arranged along the rolling axis with respect to the inlet of the multi-stand rolling mill. The insertion of the mandrel continues by leaving the first stand of the multi-stand rolling mill, reversely into the hollow body, and the rear mandrel end which projects from the tail of the hollow body is finally hooked to a mandrel conveyor on the inlet side of the multi-stand rolling mill. To such a purpose, said rear end of the mandrel is provided with specific tong suitable for hooking. At this point, the mandrel is placed in accordance with the features of the hollow body used and of the tube to be produced. The hollow body is then pushed into the multi-stand rolling mill by means of driven feeding rollers, while the mandrel reversely proceeds at controlled rolling speed.

The control system of the rolling plant includes rolling the last part of the tube (tail or rear portion) in the last stand where the thickness of the tube wall is rolled, when the mandrel head is located just downstream of the stand, thus eliminating the need to use a further extracting rolling mill to extract the rolled tube from the mandrel. Such a point is conventionally called meeting point between mandrel and rolled tube.

Then, the tube moves towards the outlet of the multi-stand rolling mill while the mandrel continues moving in the opposite direction towards the inlet area of the rolling mill. Due to these relative movement kinematics between mandrel and tube, the time interval during which the already rolled tube overlaps the mandrel which is held in the inner cavity thereof is reduced. Thereby, the tube cooling is decreased, caused by the contact with the mandrel body which has a lower temperature than the tube and thus facilitating the possible subsequent rolling operation thereon in order to decrease the outer diameter without necessarily proceeding with intermediate heating.

Once the tube has been separated from the mandrel, it is stopped downstream of the multi-stand rolling mill in a position which is completely free from the volume of the rolling mill, while the mandrel used is stopped at the inlet of the rolling mill in a position in which the mandrel tip is arranged completely outside the rolling mill stands and totally free from the volume of the rolling mill.

At this point, on the inlet side, the mandrel used in that rolling cycle just completed is laterally removed from the rolling axis to an out-of-line position, so as to free the rolling line. At the same time or immediately thereafter, the next hollow body is loaded from out-of-line to the rolling axis in order to start the next rolling cycle with the same previous sequence.

Such operations of clearing the mandrel from the line at the inlet and insertion area on the line of the next hollow body may be obtained in various manners, e.g. by employing two rotating arms which operate co-ordinately.

On the outlet side of the multi-stand rolling mill, the tube rolled in the rolling cycle just completed, in the stationary position reached after braking, is removed from the rolling axis to out-of-line by means of various systems, e.g. by means of a rotating arm. The mandrel which is to be used for rolling in the next cycle is transferred from out-of-line to the rolling axis, e.g. by means of rotating arms as well. The movement of these two rotating arms may be coordinated in order to decrease the cycle times.

In this cycle, similarly to all the previous cycles in the process, the new mandrel is reversely inserted into the rolling mill, thus reproducing all the stages of the operation described above for the previous cycle.

Certain advantages brought about by the process according to the invention are as follows:

High productivity is kept and long tubes can be rolled,

There is no need to provide an extracting rolling mill in the plant which implements the process, The work travel of the mandrel conveyor arranged on the inlet side of the rolling mill is decreased, Dead times are reduced, i.e. the difference between the cycle time and the tube rolling time in the stage when it is held in the stands of the multi-stand rolling mill, The dangers of the tube getting stuck on the mandrel due to the tube sliding under the rollers of the extractor during the stage of extracting the mandrel from the cavity of the rolled tube are eliminated, Shorter tubes than those normally rolled by known retained-mandrel rolling mills may also be rolled.

Tubes with a thinner wall may also be rolled.

The dependent claims refer to preferred embodiments of the invention.

BRIEF DESCRIPTION OF THE DRAWINGS

Further features and advantages of the invention will become more apparent in light of the detailed description of preferred, but not exclusive, embodiments of a tube rolling process according to the invention, shown by way of non-limiting example with the aid of the accompanying drawings, in which.

The same numerals in the various figures correspond to the same elements or components.

DETAILED DESCRIPTION

Figure 1:
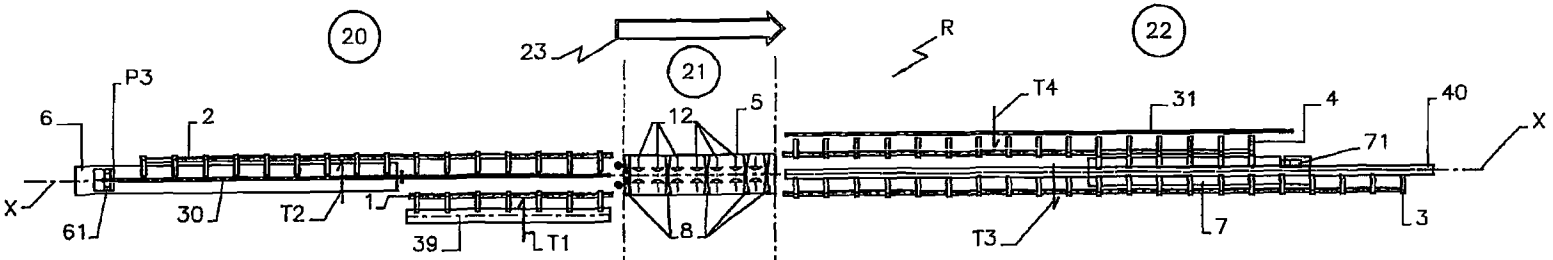
FIG. 1 diagrammatically shows a plan view of a tube rolling plant in which a stage of the tube rolling process of the invention is performed, FIG. 2 diagrammatically shows a plan view of the plant in FIG. 1 at one stage of the process after that in FIG. 1, FIG. 3 diagrammatically shows a top view of the plant in FIG. 1 at one stage of the process after that in FIG. 2, FIG. 4 diagrammatically shows a top view of the plant in FIG. 1 at one stage of the process after that in FIG. 3, FIG. 5 diagrammatically shows a top view of the plant in FIG. 1 at one stage of the process after that in FIG. 4, FIG. 6 diagrammatically shows a top view of the plant in FIG. 1 at one stage of the process after that in FIG. 5.

With reference to the figures, a preferred embodiment of a rolling plant operating with a mandrel at controlled speed is shown, globally indicated by reference R, which may implement a continuous rolling process of tubes with mandrel at controlled speed and high productivity, according to the invention. The rolling plant defines a rolling axis X and a rolling direction 23 followed by the material to be rolled, called hollow body 39, and by the rolled tubes 40, which direction is depicted from left to right in the figures. The rolling direction 23 is the same in FIGS. 1 to 6, even if it is not indicated. The plant is conventionally divided into an inlet area or side 20, in which device 2 for unloading the mandrel from the rolling axis, and device 1 for loading the hollow body along rolling axis are located, in a properly called rolling area 21 in which the multi-stand rolling mill 5 is located, and in an outlet area or side 22, in which device 4 for loading the mandrel and device 3 for unloading the rolled tube from the rolling axis X are located.

Device 1 for loading the hollow body along rolling axis is positioned at the inlet of the multi-stand rolling mill 5 and is advantageously, but not exclusively, made in the shape of a rotating arm mounted by the side of the rolling axis. When in operation, such a device 1 for loading the hollow body picks the hollow body 39 from a lateral out-of-line position and places it along the rolling axis where rollers are arranged for supporting the hollow body and the mandrel (not shown in detail in the figures as they are devices known in the art).

Device 2 for unloading the mandrel from the rolling axis is also positioned at the inlet of the multi-stand rolling mill 5 and is advantageously, but not exclusively, made with a rotating arm mounted by the side of the rolling axis X. Device 2 for unloading the mandrel is mounted at the inlet of the multi-stand rolling mill 5 on the side opposite to that of device 1 for loading the hollow body with respect to the rolling axis X.

When in operation, device 2 picks mandrel 30 which served to roll tube 40, from the rolling axis X at the end of each rolling cycle, and transports it to a lateral position outside the rolling line. This position forms part of a device for re-circulating the mandrels used in the process which includes, in a known manner not shown in detail in the figures, operations of cooling the mandrel, the temperature of which rose due to the heat received from the tube during the rolling operation, and lubricating operations before being conveyed to the outlet side 22 of the rolling mill for employment in other rolling cycles.

Device 3 for unloading the rolled tube 40 from the rolling axis X is positioned at the outlet of the multi-stand rolling mill 5 and is, advantageously but not exclusively, made in the shape of a rotating arm mounted by the side of the rolling axis X, which picks tube 40 at the end of rolling and transports it to a lateral position out-of-line from the rolling axis, for possible storing or for other machining or operations. This device 3 for unloading the tube from the rolling axis X is mounted at the outlet of the multi-stand rolling mill on the same side as device 1 for loading the hollow body, shown in the bottom section of the figures with respect to the rolling axis X.

Device 4 for loading the mandrel along rolling axis X is positioned at the outlet of the multi-stand rolling mill 5 and is advantageously, but not exclusively, made in the shape of a rotating arm mounted by the side of the rolling axis X. When in operation, it picks mandrel 31 from a lateral out-of-line position and puts it down along rolling axis X where rollers are arranged for supporting the mandrel and the tube which forms part of conveyor 7 of the mandrel on the outlet side 22 (they are also not depicted in detail because of known art). Device 4 for loading the mandrel is mounted at the outlet of the multi-stand rolling mill 5 on the same side as device 2 for unloading the mandrel, shown in the top section of the figures with reference to the rolling axis X.

The multi-stand rolling mill 5 is advantageously, but not exclusively, made as alternate stand rolling mill with two or more rollers per stand, in which the stands follow one another so that the jumps by the rollers of the odd stands along the rolling axis X correspond with the groove bottoms of the even stands and vice versa. The process of the invention may also be implemented by means of rolling mills of tubes of other type, without departing from the spirit of the invention.

Figure 7:
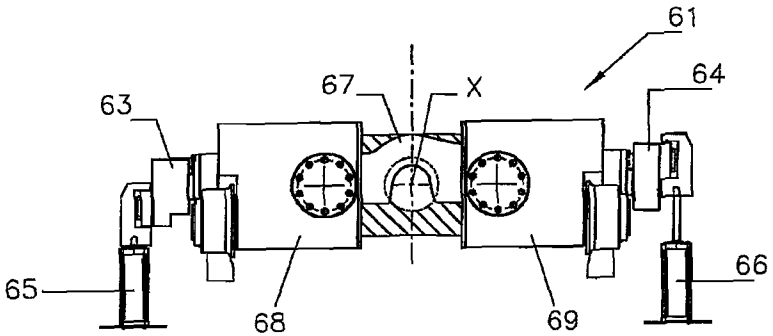
FIG. 7 shows a view in a direction parallel to the rolling axis X, of an element of the plant in FIG. 1, in a first operating position.
Figure 8:
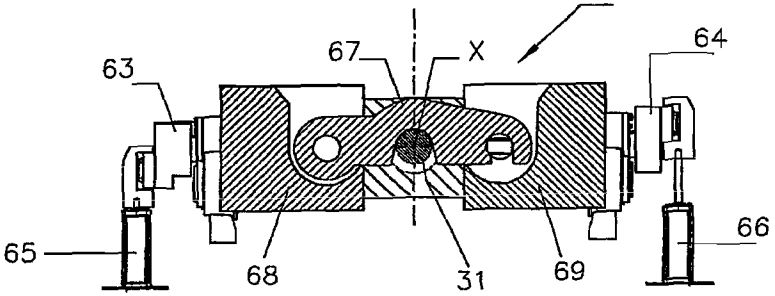
FIG. 8 shows a sectional view on a plane orthogonal to the rolling axis X of the element in FIG. 7.
Figure 9:
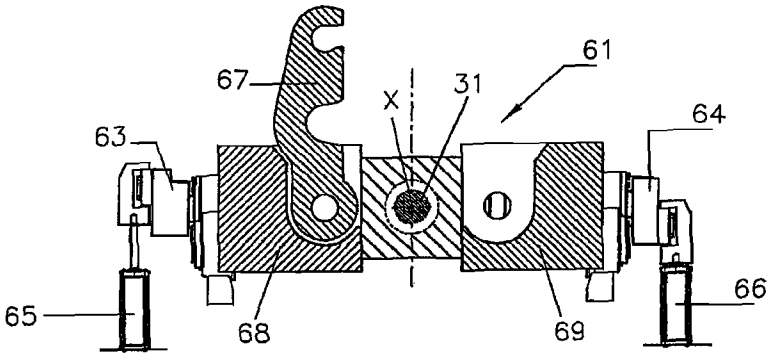
FIG. 9 shows a sectional view on a plane orthogonal to the rolling axis X of the element in FIG. 7, in a second operating position.

The mandrel conveyor 6 on the inlet side 20 essentially comprises a mandrel support device with height-adjustable rollers and a longitudinal mandrel-moving system, preferably, but not exclusively, of the rack type with motorized driving pinions. The mandrel conveyor is also equipped with a hooking and releasing device 61 by means of which it engages the tong arranged in the rear area of the mandrel. The hooking and releasing device 61 is of the so-called "drawbridge" type and acts in connection with the rear tong of the mandrel. The closed position of the drawbridge is shown in FIGS. 7 and 8, while the open position is shown in FIG. 9. Device 61 goes from a hooking position to a releasing position by means of a counter-clockwise rotation, which is considered in the depiction in the figures. Instead, the passage from releasing to hooking occurs with the clockwise rotation.

Device 61 comprises two separate heads 68, 69 which are respectively fixed to the front end of a rack device (not shown), a lever 67, hinged on the first head 68, consisting of the drawbridge which is engaged at the other end in a slot arranged in the second head 69 and with the top part of the rear tong of the mandrel, such a lever 67 being shaped in the middle with an upside down U-shaped groove. It is also possible to arrange the elements of device 61 so as to provide the fulcrum of lever 67 arranged on head 69 and having the same functions with rotation in direction inverse to the previous variant.

Device 61 also comprises a device 63 for controlling the rapid opening and closure of lever 67, in turn controlled by a movable cam 65. Advantageously, there is a device 64 for locking device 61 in closed position, which is controlled by a respective movable cam device 66. The mandrel conveyor 7 on the outlet side 22 comprises a mandrel support device consisting of height-adjustable rollers and a longitudinal mandrel-moving system, preferably, but not exclusively, of the rack type with motorized driving pinions.

Figures 10, 11, 12:
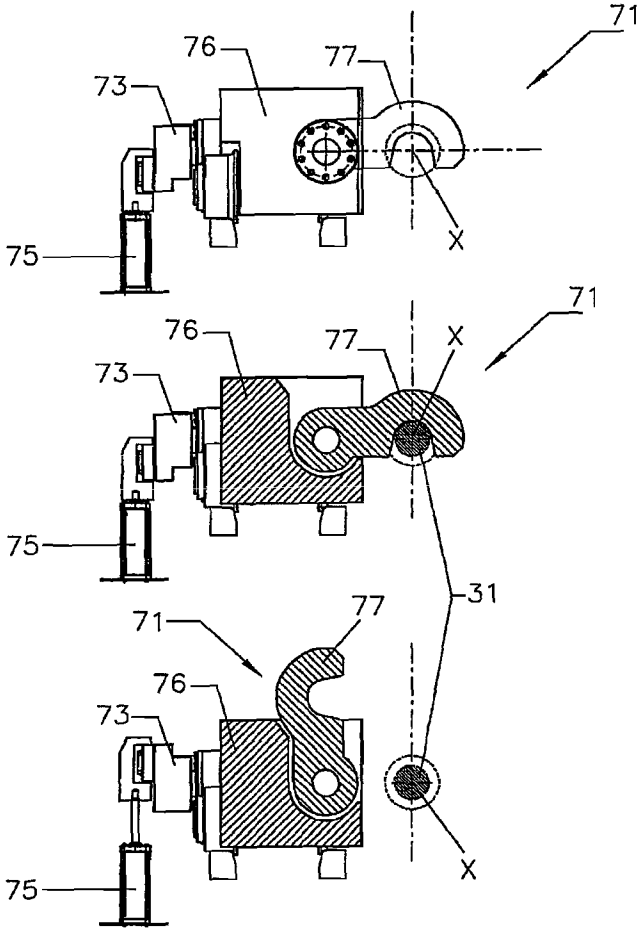
FIG. 10 shows a view in a direction parallel to the rolling axis X, of a further detail of the plant in FIG. 1.
FIG. 11 shows a sectional view on a plane orthogonal to the rolling axis X, of the element in FIG. 10.
FIG. 12 shows a sectional view on a plane orthogonal to the rolling axis X, of the element in FIG. 10, in a second operating position.

The mandrel conveyor 7 on the outlet side 22 has a drawbridge hooking and releasing device 71, in which it engages a tong of the mandrel arranged close to the head end of the mandrel. The hooking position of device 71 is shown in the two FIGS. 10 and 11, while the mandrel releasing position of the device is shown in FIG. 12.

Device 71 comprises a head 76 fixed to the front end of a rack of the outlet side of the rolling mill, a lever 77 which consists of the drawbridge, hinged onto head 76. The hooking and releasing device 71 is only adapted to engage the mandrel on the top part of the tong, but not on the bottom part thereof, lever 77 being equipped with an upside down U-shaped groove. Device 71 goes from a hooking position to a releasing position by means of a counter-clockwise rotation, which is considered in the depiction in the figures. Instead, the passage from releasing to hooking occurs with the clockwise rotation.

It is also possible to arrange the head 76 on the other side of the rolling axis X with the same functions achieved by rotating the lever in the inverse direction. Device 71 also comprises a control device 73 mounted on the rack and controlled by a movable cam 75.

The hooking and releasing devices 61 and 71, on the inlet side 20 and on the outlet side 22, incorporated in the respective conveyors 6 and 7 thereof have the advantage that the mandrel hooking and releasing operations, which is operating in a given rolling cycle, at the head and tail, may be cyclically and quickly achieved at each cycle, unlike the hooking and releasing devices which only provide these operations in emergency cases.

Moreover, the hooking and releasing operation of the mandrel conveyor 6 on the inlet side 20 is also to be accurately and promptly coordinated with the hooking and releasing device of the mandrel conveyor 7 on the outlet side 22.

Mandrel-supporting stands 8 are also provided in the rolling mill 5, the function of which is to keep mandrel 31 centered to prevent the mandrel, in the reverse passage in the inverse direction to the rolling direction 23, through the rolling stands 12 and in the possible rounding stand 10, if there is no tube, from knocking the rollers thus causing damages to the rollers and/or to the mandrel. The mandrel-supporting stands 8 are devices of known art consisting of adjustable rollers which can be closed at the dimension of the mandrel and quickly opened to allow the passage of the hollow body in the rolling stage.

Advantageously, but not necessarily, the rolling plant R provides certain devices which further improve the rolling process, which may all be present together or which may be inserted individually. Provided on the inlet side 20 along the rolling line X is a guillotine-like stopping device 9, also called in short "emergency guillotine", adapted to be activated in case of emergency to extract the mandrel from the tube. The emergency guillotine 9 consists of a retractable "U"-shaped resting plane which is movable between a non-interfering position and an interfering position with the tail section of the hollow body. Such a plane is used to create a contrast to the movement of the hollow body or of the tube should the rolling remain uninterrupted while the hollow body or the tube being rolled is still inserted on the mandrel. The emergency guillotine 9 may be positioned in various points on the inlet side 20, however always on the rolling axis X. A preferred solution is that of arranging the emergency guillotine 9 on the inlet side 20 while leaving a space between the tip of the mandrel, when it is in completely retracted position and is hooked to the hooking and releasing device 61 in emergency extraction position, and the rear edge of the hollow body when it is positioned in-line in the inlet area 20.

It is also possible to provide a rounding stand 10 arranged downstream of the last rolling stand 12, which rolls the thickness. The rounding stand 10 serves the purpose of creating an approximately even clearance between mandrel and inner diameter of the tube, and may also be used as effective device for braking the tube in the last stage of the rolling cycle. When the tail of the rolled tube leaves the last stand which decreases the thickness, the tube may be braked by using the rounding stand, such operation allows the cycle times and the spaces required to brake the tube at the end of rolling, to be decreased. Alternatively, it is also possible to provide several rounding stands 10 arranged in sequence along the rolling line X.

Furthermore, a device 11 for feeding the hollow body into the rolling mill may also be provided in the rolling plant R. The feed device 11 (only shown for simplicity in FIG. 4) preferably comprises one or more series of contrasting rollers, at least one of which is motorized, which move from a diametral position with respect to the non-interfering hollow body to one in contact with the hollow body, after the hollow body was loaded along rolling axis X. Such a feed device 11 allows the hollow body to be fed in the multi-stand rolling mill 5 under conditions of controlled speed and position.

Furthermore, the feed device 11 may advantageously, but not necessarily, be employed to keep the hollow body stationary in position during the reverse insertion stage of the mandrel therein.

By means of the rolling plant R according to the above-described invention, a tube rolling process is implemented according to the invention, the stages of which are described in detail below. Conventionally, unless otherwise specified, the indications "front" and "rear" of the various elements refer to the rolling direction 23, i.e. front refers to the tip of arrow 23, rear refers to the tail of arrow 23.

With reference to FIG. 1, the rolling plant R is depicted in a start stage of a cycle whatever the tube rolling process of the invention, when the plant operates at speed, indicated as cycle "n" to generalize this description, where "n" indicates an ordinal number referring to a general rolling cycle. Present on the outlet side 22, along the rolling line X, is a tube 40 which was already completely rolled in previous cycle "n−1", and from which mandrel 30, which served for the rolling thereof, was already completely extracted, ready to be removed from the rolling line X by activating the rotating arm 3 in the lateral direction indicated by arrow T3.

At this stage, mandrel 30 is arranged on conveyor 6 on the inlet side 20, ready to be removed from the rolling line X by activating the rotating arm 2 in the lateral direction indicated by arrow T2.

At this stage, another mandrel 31 is positioned on the side of the rolling line X on the outlet side 22 for the rolling operation of the "n" cycle ready to be inserted on the rolling line X by activating the rotating arm 4 in the lateral direction indicated by arrow T4. At this stage, device 71 for hooking the mandrel on the outlet side 22 is arranged along the rolling line at the height of the head of the mandrel 31 in the hooking position P1, and the hooking device 61 on the inlet side 20 is at the rear part of mandrel 30, which is already disengaged in releasing position P3.

A hollow body 39 is ready by the side of the rolling line, to be inserted on the rolling line X by activating the rotating arm 1 in the direction of arrow T1, to be subjected to the "n" rolling cycle.

Figure 2:
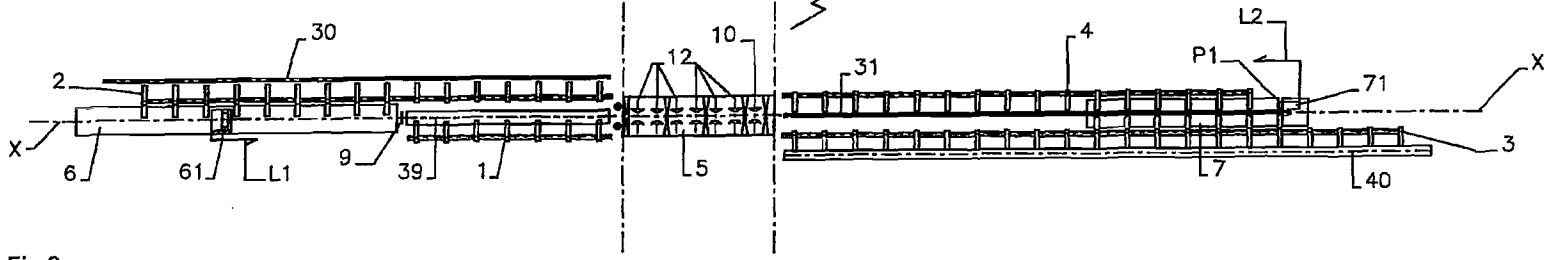

FIG. 2 shows a subsequent stage of the rolling process. Here mandrel 30 has been removed from the rolling line by the rotating arm 2 and is at the top side with respect to the figure, or left side with respect to the rolling line X, ready to continue undergoing other operations before returning to the outlet side 22, where it will serve for a next rolling cycle, which is not necessarily cycle n+1, as the amount of mandrels employed in the process may be large, if the operations of cooling and lubricating the mandrel are longer than the cycle time of the proper rolling.

The hollow body 39 to be rolled in the "n" rolling cycle is inserted on the rolling axis X with a rotation of the rotating arm 1 with the front tip of the hollow body 39 at the feeding device 11.

The hooking device 61 is caused to move towards the rear end of the hollow body 39 as shown by arrow L1 between the releasing position P3 and the hooking position P4. In this stage, co-ordinately with the operations described above for the inlet side 20, operations are also performed on the outlet side 22 in which the rolled tube is removed from the rolling line X in direction of the side shown in the figures towards the bottom of line X with a rotation of the rotating arm 3. Mandrel 31 is co-ordinately loaded along rolling axis X with a rotation of the rotating arm 4 and the front part of mandrel 31 is grasped by the hooking device 71 in hooking position P1, which starts a translation motion by integrally pushing the mandrel in direction of arrow L2 contrary to the rolling direction 23.

Figures 3, 4:
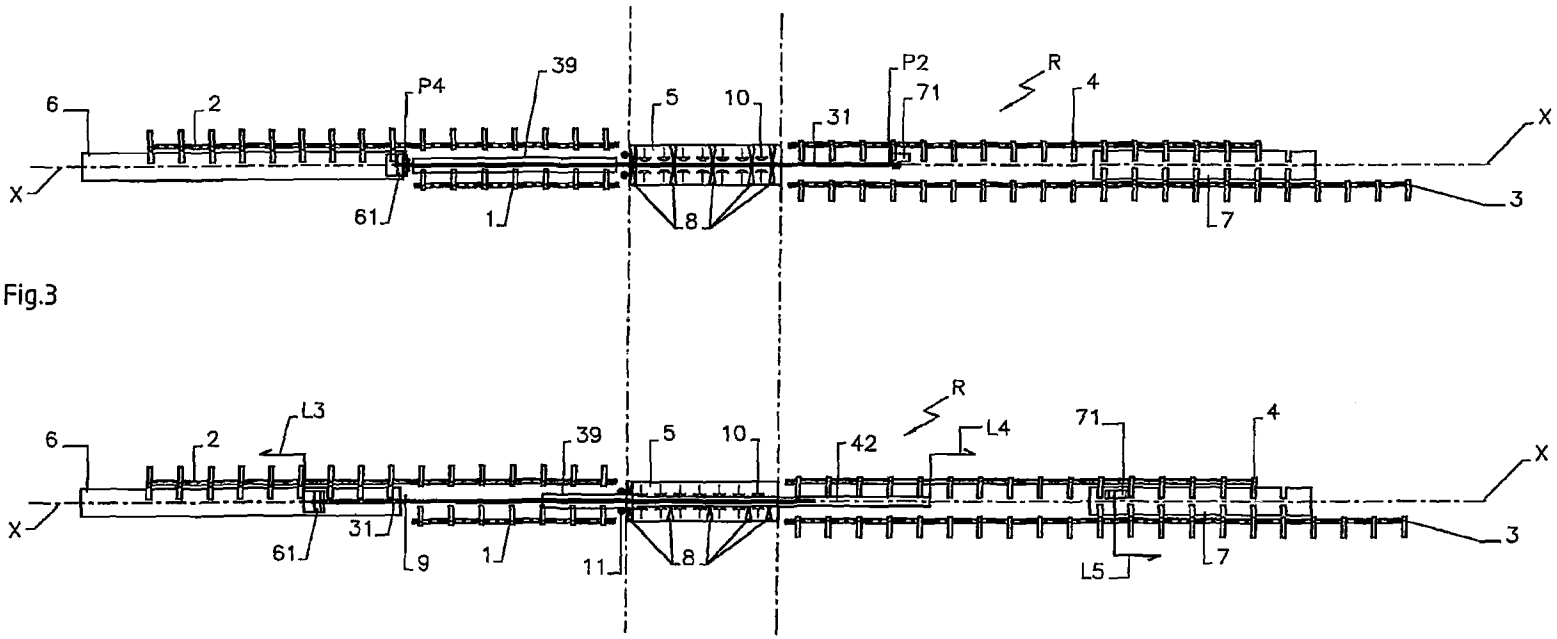

The operations of a next stage of the rolling process are shown in FIG. 3, in which mandrel 31, pushed by the hooking device 71, passes reversely, first within the multi-stand rolling mill 5, guided by the mandrel-supporting stands 8, and then, also within the hollow body 39 until the rear area of mandrel 31 is positioned at the hooking device 61 in hooking position P4. Once this position has been reached, the hooking device 71, which is in releasing position P2, releases the front part of mandrel 31 and the hooking device 61 co-ordinately grasps the rear area of mandrel 31, equipped with specific tong. Hence the hollow body 39 is taken by the feed device 11 which feeds it into the multi-stand rolling mill 5 to perform the rolling stage which is shown in FIGS. 4 and 5.

Rolling the hollow body 39 within the multi-stand rolling mill 5 occurs with the movement of mandrel 31 which is fed by the hooking device 61 in direction indicated by arrow L3, which is retrograde with respect to the rolling direction 23 between the hooking position P4 and the releasing position P3. The movement of mandrel 31 is coordinated with the movement of the hollow body 39 indicated by arrow L4, caused by the rollers of the rolling stands 12 of the rolling mill 5. The speed of the movement of mandrel 31 in the direction of arrow L3 is determined in such a way that the front end of mandrel 31 is located, completely rolled, at the rear end of tube 42 when the rear end of the tube leaves the last rolling stand 12, i.e. that furthest right between the stands indicated with numeral 12 in the depiction in the figures, thus defining the "meeting point". Thereby, mandrel 31, which is completely rolled, is completely extracted from the cavity of tube 42 after passing the meeting point.

In the meantime, the hooking device 71, now released from mandrel 31, has moved with the movement indicated by arrow L5, according to the rolling direction 23 between the releasing position P2 and the hooking position P1, where mandrel 32 will be hooked, which is to be used in the next rolling cycle "n+1".

Figures 5, 6:
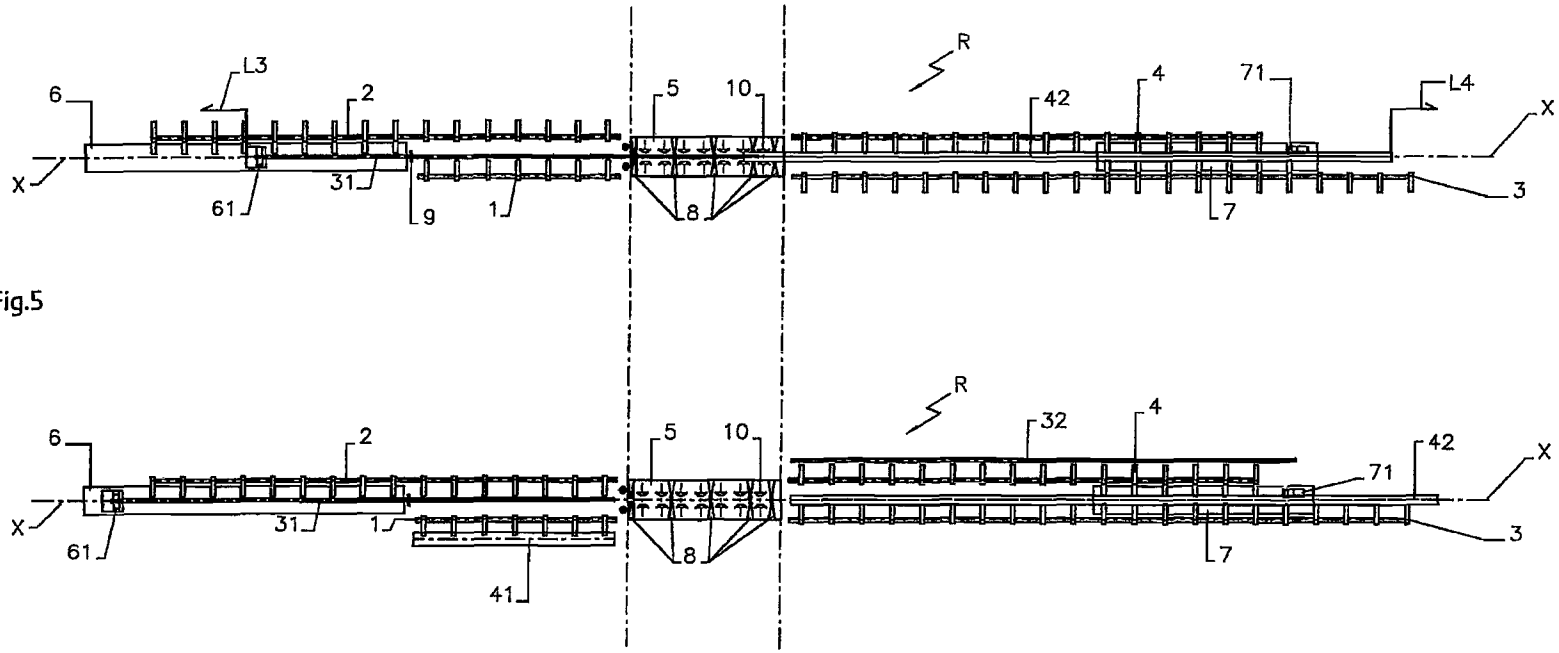

As shown in FIG. 5, in addition to being rolled by the rollers of the rolling stands 12, tube 42 may be made to pass through one or more rounding stands 10. This operation is optional and contributes to improving the shape of the finished tube.

In this last step of the rolling, mandrel 31, which has left the inside of tube 42, is braked and positioned on the rolling line X, as shown in FIG. 6, in such a position as to be outside the volume of the multi-stand rolling mill 5, so as to be removed from the rolling line at the beginning of the next rolling cycle "n+1". Obviously, the rear area of mandrel 31 is released by the grip of the hooking device 61 in releasing position P3 to allow the removal thereof by rotating the rotating arm 2.

On the outlet side 22, after having been completely removed from the volume area of the multi-stand rolling mill 5, the rolled tube 42 is ready to be removed from the rolling line X by rotating the rotating arm 3 to allow the operations to start the next rolling cycle "n+1".

The next rolling cycle "n+1" of the hollow body 41 may thus start with the same operations as the previous cycle "n" described above and by using the next mandrel 32.

What is claimed is:

1. A process for rolling a hollow body having an inner cavity to obtain a rolled tube using at least one mandrel, wherein there is provided a rolling plant comprising a rolling mill with a plurality of rolling stands, defining a rolling axis, a rolling direction, an inlet side defined upstream of the rolling mill, and an outlet side defined downstream of the rolling mill, the rolling direction going from the inlet side to the outlet side, wherein a first loading device to load the hollow body, a first unloading device to unload the mandrel and a first mandrel conveyor are provided on the inlet side, and a second unloading device to unload the rolled tube, a second loading device to load the mandrel and a second mandrel conveyor are provided on the outlet side, said process comprising, in a rolling cycle, the following stages:

loading the hollow body along the rolling axis from the inlet side by means of said first loading device, loading the at least one mandrel along the rolling axis from the outlet side by means of said second loading device and connecting a first end area of the at least one mandrel to said second mandrel conveyor, axially translating the at least one mandrel along the rolling axis through the rolling mill and through the inner cavity of the hollow body, integrally fixing a second end area of the at least one mandrel to said first mandrel conveyor and releasing the first end area of the at least one mandrel from said second mandrel conveyor, rolling the hollow body by passing the same through rolling stands of the rolling mill in the rolling direction, so as to obtain the rolled tube at the outlet side while simultaneously feeding the mandrel by means of the first mandrel conveyor in a direction opposite to the rolling direction, completely extracting the mandrel from within the rolled tube and from the rolling mill, whereby the mandrel is on the inlet side and ready to be removed from the rolling axis, removing the mandrel from the rolling axis by means of the first unloading device, and conveying the mandrel from the inlet side to the outlet side for a next rolling cycle.

2. The rolling process according to claim 1, wherein a rolled tube rounding stage is provided, performed by at least one rounding stand.

3. The rolling process according to claim 1, wherein an integral fixing of the at least one mandrel to the first mandrel conveyor, and the releasing of the at least one mandrel from the second mandrel conveyor occur in a coordinate manner.

4. The rolling plant for tubes of a predefined length, adapted to implement a rolling process according to claim 1, comprising a rolling mill incorporating a plurality of rolling stands adapted to roll a hollow body at each rolling cycle of a plurality of rolling cycles, defining a rolling axis, a rolling direction and a rolling cycle for each rolled tube, at least one mandrel adapted to cooperate with the rolling mill in said rolling at each rolling cycle, a first loading device, adapted to load the hollow body at each rolling cycle along the rolling axis, a first unloading device, adapted to unload the at least one mandrel from the rolling axis, a first mandrel conveyor, adapted to grasp and to release a rear end of said at least one mandrel, arranged upstream of the rolling mill, and a second unloading device, adapted to unload the rolled tubes from the rolling axis, a second loading device adapted to load the at least one mandrel along the rolling axis, a second mandrel conveyor, adapted to grasp and to release a front end of said at least one mandrel, arranged downstream of the rolling mill, a control means of the rolling plant which allow the first mandrel conveyor to grasp and release said rear end of the at least one mandrel at each rolling cycle co-ordinately to releasing and grasping, respectively, said front end of the at least one mandrel by the second mandrel conveyor.

5. The rolling plant according to claim 4, wherein said rolling mill comprises mandrel supporting stands.

6. The rolling plant according to claim 5, wherein the first mandrel conveyor comprises a mandrel support device with height-adjustable rollers and a longitudinal mandrel-moving system.

7. The rolling plant according to claim 6, wherein the longitudinal mandrel-moving system comprises a rack device with motorized driving pinions and a tong hooking/releasing device in a rear area of the mandrel.

8. The rolling plant according to claim 7, wherein a device for feeding the hollow body in the rolling mill is provided.

9. The rolling plant according to claim 8, wherein at least one rounding stand is provided downstream of the last rolling stand of the rolling mill.

10. The rolling plant according to claim 9, wherein a stopping device having a guillotine is provided for extracting the mandrel from the rolled tube or hollow body under emergency conditions.

* * * * *